US009457364B2

(12) United States Patent
Kim et al.

(10) Patent No.: US 9,457,364 B2
(45) Date of Patent: Oct. 4, 2016

(54) COATING-FORMING APPARATUS AND COATING-FORMING METHOD

(71) Applicant: SAMSUNG HEAVY IND. CO.,LTD, Seoul (KR)

(72) Inventors: Sangwhee Kim, Gyeonggi-do (KR); SungJoon Kim, Daejeon (KR); Eunjung Kim, Daejeon (KR); Seong Ho Cho, Daejeon (KR); KiSoo Cho, Gyeonggi-do (KR)

(73) Assignee: SAMSUNG HEAVY IND. CO., LTD, Seoul (KR)

( * ) Notice: Subject to any disclaimer, the term of this patent is extended or adjusted under 35 U.S.C. 154(b) by 134 days.

(21) Appl. No.: 14/371,060

(22) PCT Filed: Nov. 29, 2012

(86) PCT No.: PCT/KR2012/010262

§ 371 (c)(1),
(2) Date: Jul. 8, 2014

(87) PCT Pub. No.: WO2013/154246

PCT Pub. Date: Oct. 17, 2013

(65) Prior Publication Data

US 2015/0010713 A1 Jan. 8, 2015

(30) Foreign Application Priority Data

Apr. 13, 2012 (KR) ..... 10-2012-0038516

(51) Int. Cl.
*B05B 3/02* (2006.01)
*B05B 13/04* (2006.01)
(Continued)

(52) U.S. Cl.
CPC ..... *B05B 3/021* (2013.01); *B05B 3/025* (2013.01); *B05B 3/18* (2013.01); *B05B 12/004* (2013.01); *B05B 12/02* (2013.01); *B05B 13/04* (2013.01); *B05B 13/0431* (2013.01); *B05B 13/0436* (2013.01); *B05B 13/0442* (2013.01); *B05C13/02* (2013.01); *B05D 1/002* (2013.01); *B05D 1/02* (2013.01); *B05D 2254/02* (2013.01)

(58) Field of Classification Search
None
See application file for complete search history.

(56) References Cited

U.S. PATENT DOCUMENTS 5,939,145 A * 8/1999 Oram ..... B05B 13/0228 427/231
6,589,346 B2 7/2003 Schick et al.
(Continued)

FOREIGN PATENT DOCUMENTS

JP 2001-276733 A 10/2001
KR 20010108693 A 12/2001
(Continued)

OTHER PUBLICATIONS

International Search Report issued in corresponding application No. PCT/KR2012/010262 mailed Feb. 25, 2013.

*Primary Examiner* — Nathan T Leong
(74) *Attorney, Agent, or Firm* — Carter, DeLuca, Farrell & Schmidt, LLP

(57) ABSTRACT

Provided is a coating-forming apparatus. The coating-forming apparatus according to one embodiment of the present invention includes a support member rotatably supporting a tube body about the central axis thereof; a robot moving in the longitudinal direction of the tube body and spraying paint or an abrasive material on the outer circumferential surface of the tube body, a rotation-detecting device attached to the tube body and measuring the angle of rotation of the tube body, and a controller for controlling the supporting member or the robot.

3 Claims, 8 Drawing Sheets

(51) Int. Cl.

| | |
|---|---|
| ***B05B 3/18*** | (2006.01) |
| ***B05B 12/00*** | (2006.01) |
| ***B05B 12/02*** | (2006.01) |
| ***B05C 13/02*** | (2006.01) |
| ***B05D 1/00*** | (2006.01) |
| ***B05D 1/02*** | (2006.01) |

(56) References Cited

U.S. PATENT DOCUMENTS

2010/0230511 A1* 9/2010 Umezawa ..... B05B 5/1675 239/104

2011/0164244 A1* 7/2011 Honda ..... G01B 5/163 356/72

FOREIGN PATENT DOCUMENTS

| | | | |
|---|---|---|---|
| KR | 100806942 | B1 | 2/2008 |
| KR | 20080089469 | A | 10/2008 |
| KR | 20080105164 | A | 12/2008 |
| KR | 20100002709 | A | 1/2010 |
| KR | 1020100046513 | A | 5/2010 |
| KR | 101106593 | B1 | 1/2012 |
| KR | 20120008849 | A | 2/2012 |

* cited by examiner

COATING-FORMING APPARATUS AND COATING-FORMING METHOD

TECHNICAL FIELD

The present invention relates to a coating-forming apparatus and a coating-forming method, and more particularly, to an apparatus and method for automatically forming coating on a tube body.

BACKGROUND ART

A wind power generator has a tower in which one or more tube bodies are connected to each other. Blasting and coating processes are performed on outer circumferential surfaces of the tube bodies of the wind power generator to provide corrosion resistance.

Each of the tube bodies of the wind power generator has an outer diameter of about 3 m to about 4 m and a length of about 20 m. Therefore, in the existing wind power generator, the blasting and coating processes are manually performed by a worker while the tube body rotates with respect to a central axis thereof. As an example, a coating apparatus performing a coating process while rotating a tube body is disclosed in Korean Patent Laid-open Gazette No. 10-2012-0008849.

The coating apparatus disclosed in the above related document describes a configuration in which a roller supports the tube body. That is, while the roller slowly rotates the tube body, and a coating gun moves to passes through the inside of the tube body, paint is spayed onto an inner circumferential surface of the tube body.

When the blasting and coating processes with respect to an outer circumferential surface of the tube body is manually performed by the worker, there are limitations in which the processes are inefficient, the working environments are harmful, and the coating quality is non-uniform.

If the tube body has a conical shape, there is a limitation in which the paint sprayed on the outer circumferential surface of the tube body is non-uniform in density.

DISCLOSURE OF THE INVENTION

Technical Problem

The present invention provides a coating-forming apparatus automatically performing a blasting process or coating process on an outer circumferential surface of a tube body.

The present invention also provides a coating-forming apparatus uniformly applying paint on an outer circumferential of a tube body.

The present invention also provides a coating-forming apparatus uniformly applying paint on an outer circumferential of a tube body even if the tube body has a conical shape.

Technical Solution

An aspect of the present invention, a coating-forming apparatus includes: a support member rotatably supporting a tube body about a central axis thereof; a robot moving along a longitudinal direction of the tube body to spray paint or an abrasive material onto an outer circumferential surface of the tube body; a rotation-detecting device attached to the tube body to measure a rotation angle of the tube body; and a controller controlling the support member or the robot.

The rotation-detecting device may include: an angle detection member measuring an angle between an attached portion of the rotation-detecting device and the ground; and a communication member transmitting the angle to the controller.

The rotation-detecting device may further include an attachment member attaching the angle detection member and the communication member to the tube body.

The attachment member may be provided as a magnet attached to the tube body that is formed of a metal.

The coating-forming apparatus may further include a travel rail disposed parallel to the longitudinal direction of the tube body, wherein the robot includes: a travel member movably disposed on the travel rail; and an arm rotatably disposed on the travel member, the arm including a plurality of links rotatably hinge-coupled to each other, wherein the arm may include a coupling part, to which a coating gun spraying the paint or a blasting gun spraying the abrasive material is selectively coupled, on an end thereof The coating-forming apparatus may further include a transfer rail on which the support member is movable.

Another aspect of the present invention, a coating-forming method includes: dividing an outer circumferential surface of a tube body into a plurality of sections; and spraying paint or an abrasive material on the plurality of sections by using a robot having a spray gun on an end thereof, wherein the spraying of the paint or abrasive material includes: spraying the paint or abrasive material on one section of the plurality of sections; rotating the tube body with respect to a central axis thereof; measuring a rotation angle of the tube body; correcting a position of the spray gun; and spraying the paint or abrasive material on the other section of the plurality of sections.

The robot may adjust the position of the spray gun according to a difference between an increase value of the angle due to the rotation of the tube body and a preset rotation angle.

The rotation of the tube body may be performed by rotating a pair of rollers disposed on the plurality of support members that are spaced apart from each other on the basis of an angle measured by a rotation-detecting device attached to the tube body.

The tube body may have a conical shape.

The rollers may have diameters different from each other.

The tube body may be a tower of a wind power generator or a portion of the tower.

Each of the sections may be divided by a plurality of virtual straight lines connecting one end of the tube body to the other end of the tube body, and the robot may move from the one end of the tube body to the other end of the tube body while vertically moving the spray gun.

ADVANTAGEOUS EFFECTS

According to the embodiment of the present invention, the blasting process or the coating process may be automatically performed on the outer circumferential surface of the tube body.

Also, according to the embodiment of the present invention, the paint may be uniformly applied to the outer circumferential surface of the tube body.

Also, according to the embodiment of the present invention, the paint may be uniformly applied to the outer circumferential surface of the tube body having the conical shape.

MODE FOR CARRYING OUT THE INVENTION

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Therefore, in the figures, the dimensions of layers and regions are exaggerated for clarity of illustration.

Figure 1:
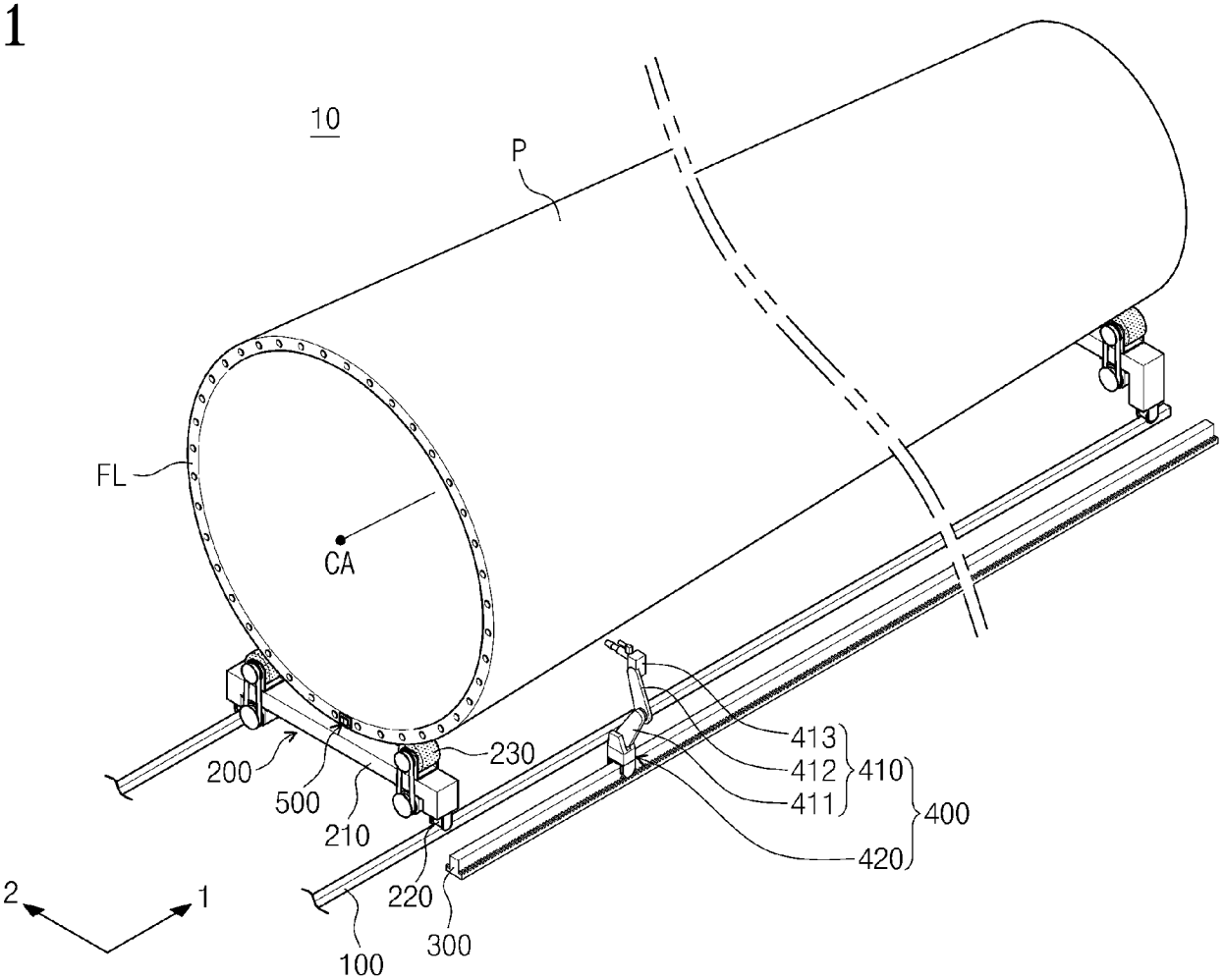
FIG. 1 is a perspective view of a coating-forming apparatus according to an embodiment of the present invention.

FIG. 1 is a perspective view of a coating-forming apparatus according to an embodiment of the present invention.

Referring to FIG. 1, the coating-forming apparatus 10 includes a transfer rail 100, a support member 200, a travel rail 300, a robot 400, a rotation-detecting 500, and a controller 600.

Hereinafter, longitudinal directions of the transfer rail 100 and the travel rail 300 are referred to as a first direction 1, and when viewed from above, a direction perpendicular to the first direction 1 is referred to as a second direction 2.

The transfer rail 100 has a longitudinal direction provided along the first direction 1. A pair of transfer rails 100 are spaced apart from each other in the second direction 2.

The support member 200 supports both sides of a tube body P. The support member 200 includes a frame 210, a transfer member 220, and a roller 230. At least two support members 200 are spaced apart from each other in the first direction 1. Each of the support members 200 is movably disposed on the transfer rails 100 in the first direction 1. The frame 210 has a longitudinal direction provided along the second direction 2. The frame 210 has a length corresponding to a distance between the pair of transfer rails 100.

A pair of transfer members 220 are disposed on both ends of a bottom surface of the frame 210. The transfer members 220 are disposed on the transfer rails 100, respectively. The transfer members 220 may be provided as wheels which are movable along the transfer rails 100. When the coating process with respect to the tube body P is completed, the tube body P is transferred by the support members 200 along the first direction 1 toward a place where the travel rail 300 is not provided, and then is unloaded from the support members 200. A new tube body P is loaded on the support members 200 and transferred to the first direction 1.

A pair of rollers 230 are disposed on a top surface of the frame 210. Each of the rollers 230 may be rotated with respect to a central axis of the roller 230, which is parallel to the first direction 1. When the tube body P is located on the support members 200, the roller 230 supports the outer circumferential surface of the tube body P. The roller 230 has a diameter by which the tube body P is spaced a predetermined distance upward from the top surface of the frame 210. The tube body P may be a tower of the wind power generator or a portion of the tower.

The tube body P may have a shape gradually increasing in diameter from one end to the other end thereof. For example, the tube body P may have a conical shape. In an embodiment, the rollers 230 may have the same diameter, and the rollers 230 respectively disposed on the support members 200 have rotation speeds different from each other. That is, the roller 230 of the support member 200 supporting a portion having a relatively large diameter of the tube body P is rotated at a relatively high speed, and the roller 230 of the support member 200 supporting a portion having a relatively small diameter of the tube body P is rotated at a relatively low speed.

In another embodiment, the rollers 230 disposed on the different support members 200 have different diameters. That is, the roller 230 supporting the portion having the relatively large diameter of the tube body P has a relatively large diameter, and the roller 230 supporting the portion having the relatively small diameter of the tube body P has a relatively small diameter. In this case, the rollers 230 on the each of the support members 200 may have the same rotation speed.

In another embodiment, the tube body P may have a cylindrical shape which has a constant diameter along the longitudinal direction. The rollers 230 disposed on the frame 210 are controlled to rotate in the same direction. The rollers 230 disposed on the same support member 200 are controlled to rotate at the same speed. When the rollers 230 rotate, the tube body P rotates with respect to a central axis CA.

The travel rail 300 has a longitudinal direction provided along the first direction 1. The travel rail 300 is spaced apart from the support member 200 along the second direction 2.

Figure 2:
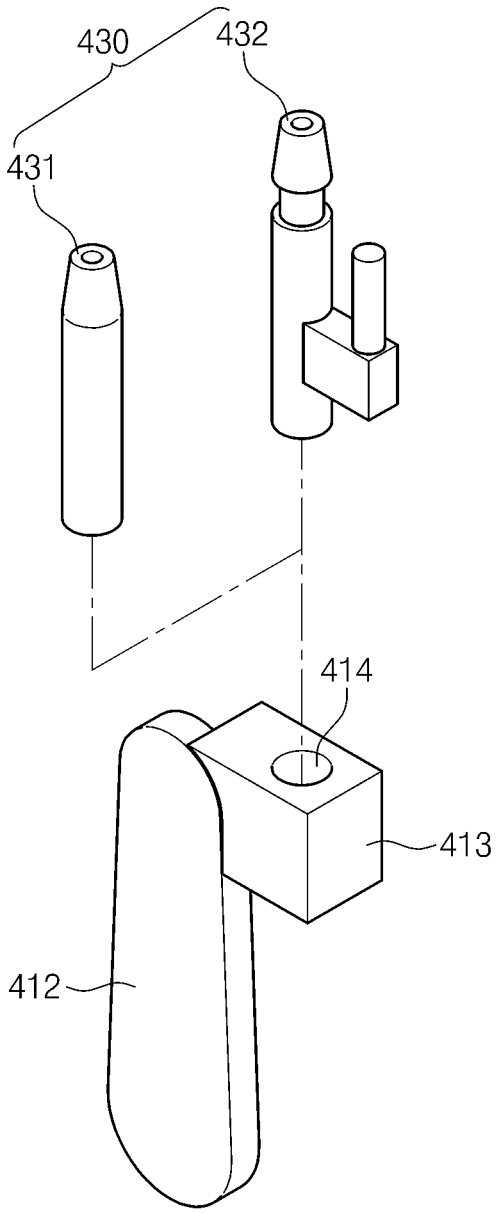
FIG. 2 is a view illustrating a state where a blasting gun or a coating gun is attached to or detached from a robot.
Figure 3:
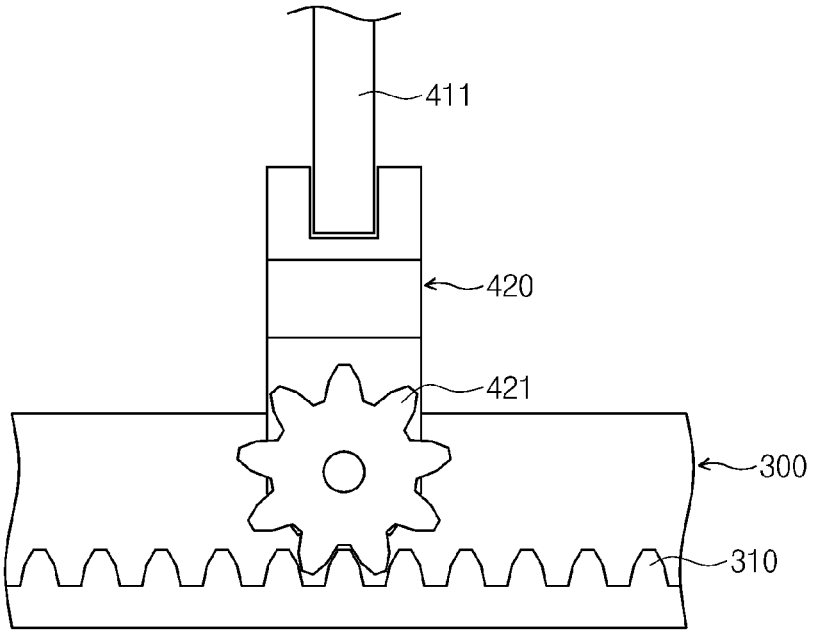
FIG. 3 is a view illustrating a state where the robot is located on a travel rail.

FIG. 2 is a view illustrating a state where a blasting gun or a coating gun is attached to or detached from a robot, and FIG. 3 is a view illustrating a state where the robot is located on a travel rail.

Referring to FIGS. 1 to 3, the robot 400 includes an arm 410 and a travel member 420. The arm 410 has a plurality of links which are rotatably hinge-coupled to each other. As an example, the arm 410 may include a first link 411, a second link 412, and a third link 413. The first, second, and third links 411, 412, and 413 are hinge-coupled to each other so that the second link 412 is rotated with respect to the first link 411, and the third link 413 is rotated with respect to the second link 412. Also, the first link 411 may be rotatably hinge-coupled to the travel member 420.

A coupling part 414 is provided on the third link 413. A spray gun 430 is coupled to the coupling part 414. The spray gun 430 is provided with a blasting gun 431 or a coating gun 432. When the blasting process is performed on the outer circumferential surface of the tube body P, the blasting gun 431 is mounted on the coupling part 414. The blasting gun 431 sprays an abrasive material onto the outer circumferential surface of the tube body P to remove foreign substances attached on the outer circumferential surface of the tube body P. When the coating process is performed on the outer circumferential surface of the tube body P, the coating gun 432 is mounted on the coupling part 414. The robot 400 may spray paint into the coating gun 432 to perform the coating process on the outer circumferential surface of the tube body P. When the blasting and the coating processes are performed, a coating is formed on the tube body P.

The travel member 420 is disposed on the travel rail 300. When the travel member 420 is driven, the robot 400 moves in the first direction 1. A pinion 421 is provided on the travel member 420, and a rack 310 engaged with the pinion 421 is provided on the travel rail 300. Therefore, the robot 400 may move along the travel rail 300 without sliding.

Figure 4:
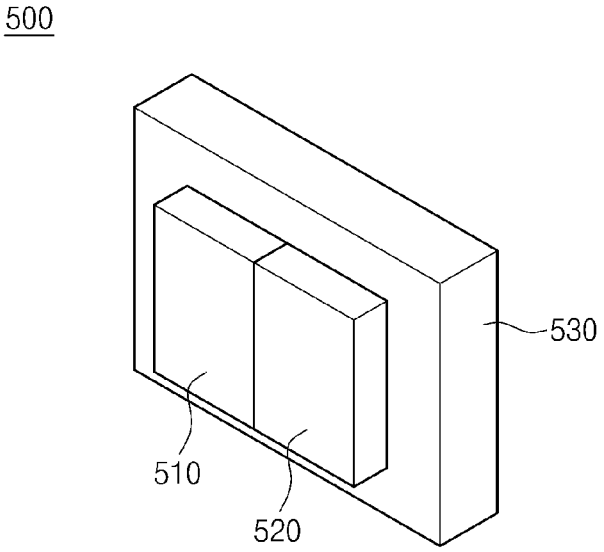
FIG. 4 is a view of a rotation-detecting device.
Figure 5:
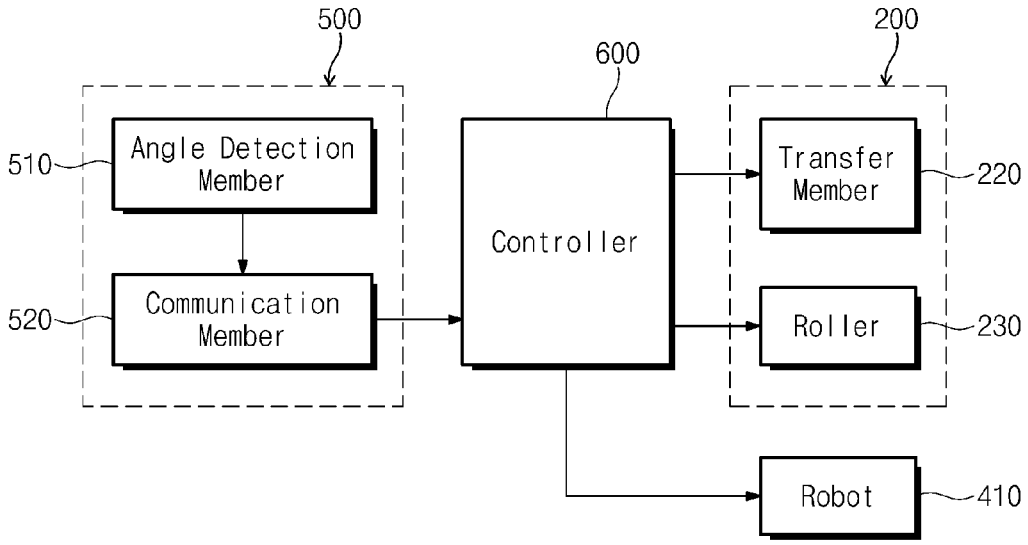
FIG. 5 is a block diagram of the coating-forming apparatus of FIG. 1.

FIG. 4 is a view of a rotation-detecting device, and FIG. 5 is a block diagram of the coating-forming apparatus of FIG. 1.

Referring to FIGS. 1, 4, and 5, the rotation-detecting device 500 includes an angle detection member 510 and a communication member 520. The angle detection member 510 and the communication member 520 are coupled to the attachment member 530. The rotation-detecting device 500 is attached to a position, where the blasting process or the coating process is not performed, by the attachment member 530. Thus, the rotation-detecting device 500 is attached on a flange FL disposed on the both ends of the tube body P or the inner circumferential surface of the tube body P to connect the tube bodies P to each other. The attachment member 530 may have different shapes according to the position where the rotation-detecting device 500 is attached. Therefore, when the rotation-detecting device 500 is attached to the flange FL, the attachment member 530 has a flat plate shape. Also, when the rotation-detecting device 500 is attached to the inner circumferential surface of the tube body P, the attachment member 530 has a plate shape.

When the tube body P is provided as a metal, a magnet may be used as the attachment member 530. Selectively, the attachment member 530 may attach the rotation-detecting device 500 to the tube body P in a vacuum adsorption manner.

The angle detection member 510 measures an angle of a portion of the tube body P to which the rotation-detecting device 500 is attached with respect to the bottom on which the transfer rail 100 and the travel rail 300 are mounted. When the portion, to which the rotation-detecting device 500 is attached, rotates, the angle detected by the angle detection member 510 is changed. A rotation angle of the tube body P may be seen by subtracting an angle detected by the angle detection member 510 before the roller 230 is rotated from an angle detected by the angle detection member 510 after the roller 230 rotates to rotate the tube body P. As an example, the angle detection member 510 may be provided as an inclinometer.

The communication member 520 transmits the angle detected by the angle detection member 510 to the controller 610. The communication member 520 receives the angle detected by the angle detection member 510 to transmit the received angle to the controller 610. The communication member 520 may be wiredly or wirelessly connected to the controller 600.

The controller 600 receives the angle transmitted from the communication member 520. The controller 600 controls each of the transfer member 220, the roller 230, and the robot 400.

Figure 6:
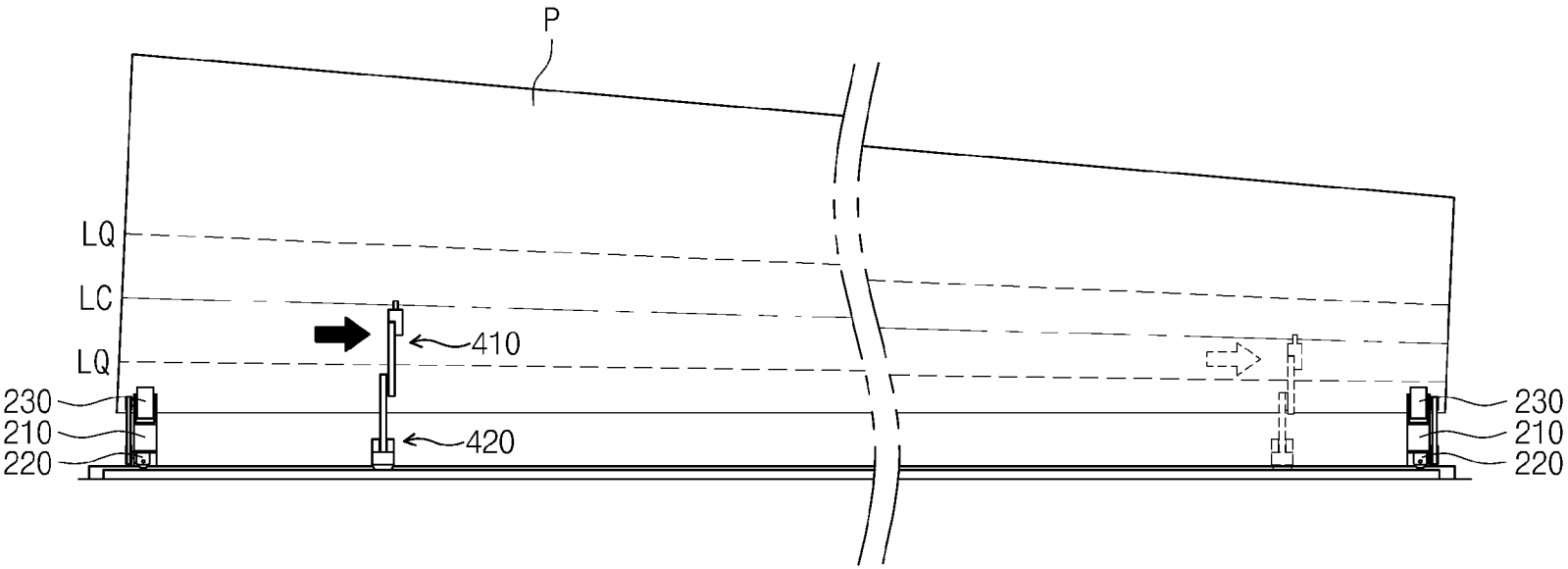
FIG. 6 is a side view of the coating-forming apparatus performing a coating process.
Figure 7:
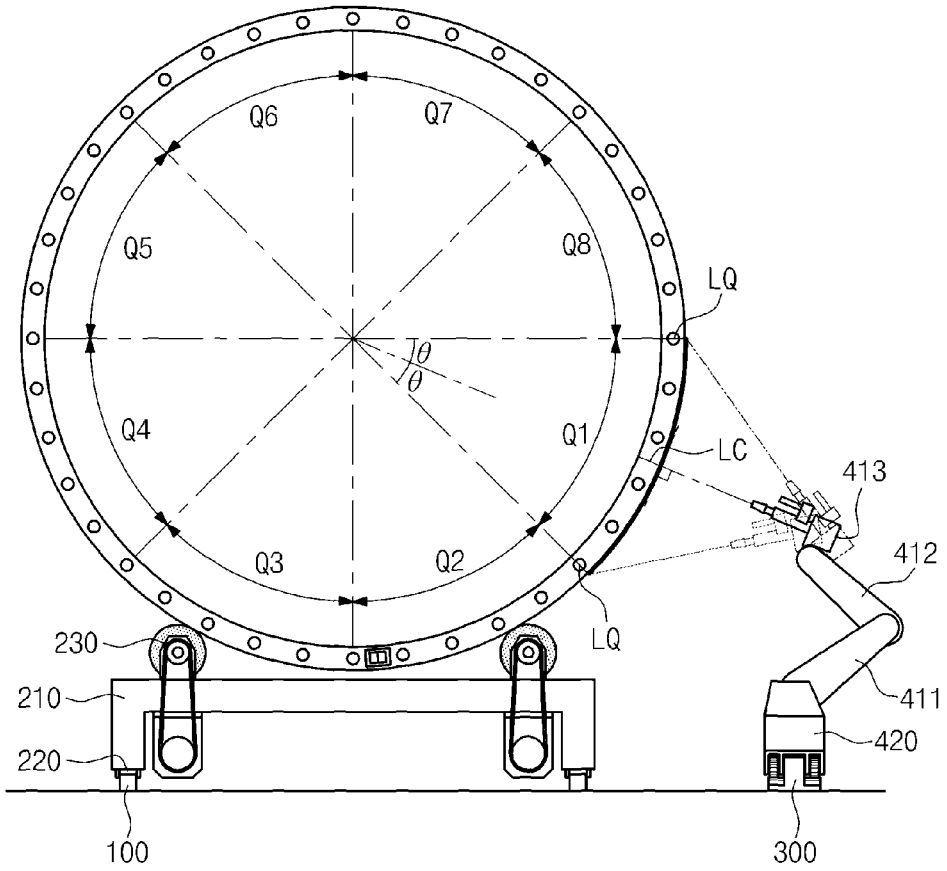
FIG. 7 is a view illustrating a state where the coating process is performed in one section.
Figure 8:
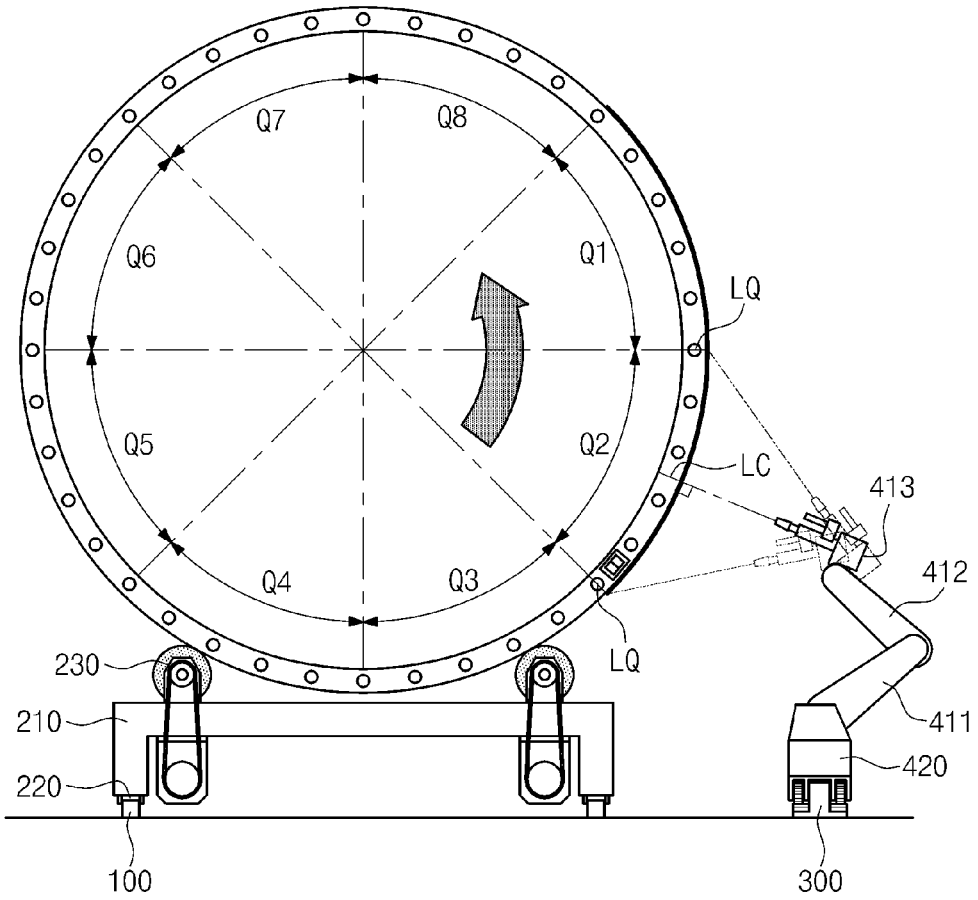
FIG. 8 is a view illustrating a state where the coating process is performed in the next section.

FIG. 6 is a side view of the coating-forming apparatus performing a coating process, FIG. 7 is a view illustrating a state where the coating process is performed in one section, and FIG. 8 is a view illustrating a state where the coating process is performed in the next section.

Hereinafter, a process of performing the coating process will be described with reference to FIGS. 6 to 8. The blasting process is the same as the coating process except that the blasting gun 431 instead of the coating gun 432 is mounted on the coupling part 414. Therefore, the coating process that will be described below may be applied to the blasting process.

The outer circumferential surface of the tube body P is divided into a plurality of sections Q1 to Q8, and the coating process is successively performed on the plurality of sections Q1 to Q8. Each of the sections Q1 to Q8 is defined by a section line LQ. The two section lines LQs adjacent to each other have a preset rotation angle 2θ with respect to the central axis CA. A central line LC is located at the center of the two section lines LQs adjacent to each other. Each of the section lines LQs and the central line LC are virtual lines. The controller 600 allows the robot 400 to move from the one end of the tube body P to the other end of the tube body P in a state where the tube body P is not rotated. While the robot moves, the controller 600 vertically moves the third link 413 to perform the coating process with respect to one section (for example, the section Q1). The controller 600 controls the robot 400 to vertically apply the paint that is sprayed from the coating gun 432 to the outer circumferential surface when the coating gun 432 faces the central line LC. Therefore, the paint applied to upper and lower portions with respect to the central line LC is applied with identical density.

When the tube body P has the conical shape, the central line LC is inclined with respect to the ground. Thus, while the robot 400 moves from the one end of the tube body P to the other end of the tube body P, the controller 600 controls a height of the coating gun 432 to match that of the central line LC.

Also, when the tube body P has the conical shape, the central line LC is inclined with respect to the central axis CA. Thus, the controller 600 controls the coating gun 432 to allow the coating gun 432 to be maintained at a constant distance from the central line LC while the robot 400 moves from the one end of the tube body P to the other end of the tube body P. When the tube body P increases in diameter, the controller 600 increases the vertical moving distance of the coating gun 432 to allow the coating gun 432 to apply the paint between the central line LC and the section line LQ.

When the robot 400 moves from the one end of the tube body P to the other end of the tube body P to perform the coating process with respect to the one section (for example, the section Q1), the controller 600 controls the roller 230 to rotate the tube body so that the other one section (for example, the section Q2) faces the coating gun.

The controller 600 moves the robot 400 from the one end of the tube body P to the other end of the tube body P to apply the paint the section Q2. The process may be repeatedly performed until all sections Q1 to Q8 are applied.

Figure 9:
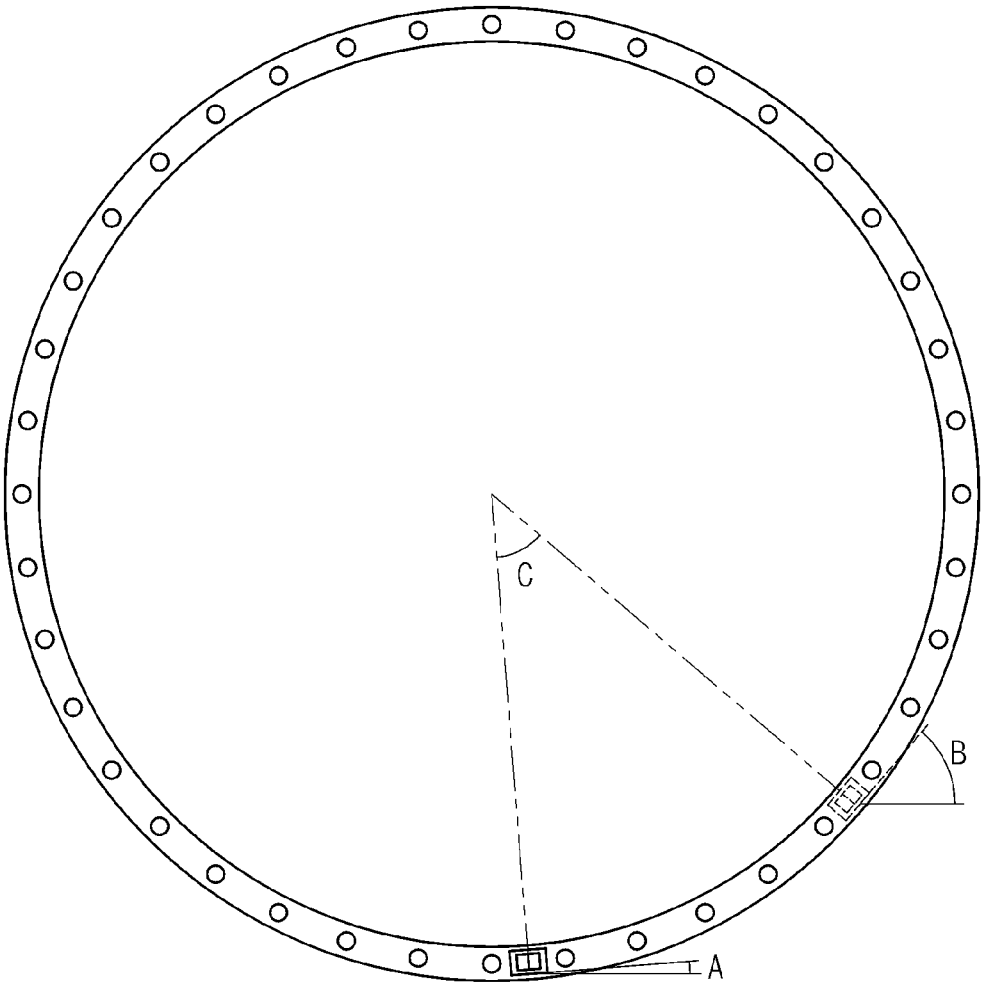
FIG. 9 is a view illustrating an angle measured by the rotation-detecting device.

FIG. 9 is a view illustrating an angle measured by the rotation-detecting device.

A process of rotating the tube body P and a process of adjusting a position of the coating gun will be described with reference to FIG. 9.

The controller 600 rotates the tube body P on the basis of the angle measured by the rotation-detecting device 500. After the controller 600 stops the roller 230, the tube body P is rotated due to the inertia thereof to cause an error value. Thus, the controller 600 rotates the tube body P until the angle measured by the rotation-detecting device 500 increases to a value corresponding to a predicted error value subtracted from the preset rotation angle 2θ. When the tube body P stops, the controller 600 compares the an angle B measured after the rotation of the tube body P with an angle A measured before the rotation of the tube body P to calculate an increase value C of the angle. The increase value C may be an actual rotated angle C of the tube body P.

The controller 600 compares the increase value C with the preset rotation angle 2θ to adjust the position of the coating gun 432. That is, the tube body P is rotated at an angle that is more or less than the set rotation angle 2θ according to a response speed of the roller. Therefore, the controller 600 controls the robot 400 to allow the coating gun 432 to be vertically disposed on the outer circumferential surface when the coating gun 432 faces a central line LC of a new section (for example, the section Q2).

The foregoing detailed descriptions may be merely an example of the prevent invention. Also, the inventive concept is explained by describing the preferred embodiments and will be used through various combinations, modifications and environments. That is the inventive concept may be amended or modified, not being out of the scope, technical idea or knowledge in the art. Further, it is not intended that the scope of this application be limited to these specific embodiments or to their specific features or benefits. Rather, it is intended that the scope of this application be limited solely to the claims which now follow and to their equivalents. Further, the appended claims should be appreciated as a step including even another embodiment.

The invention claimed is:

1. A coating-forming apparatus comprising:

a support member rotatably supporting a metal tube body about a central axis thereof;

a robot moving along a longitudinal direction of the metal tube body to spray paint or an abrasive material onto an outer circumferential surface of the metal tube body; and a rotation-detecting device attached to the metal tube body to measure a rotation angle of the metal tube body; the rotation-detecting device comprising:

an angle detection member configured for measuring an angle between an attached portion of the rotation-detecting device and a ground;

a communication member configured to transmit the angle to a controller configured to control the support member or the robot and an attachment member configured to attach the angle detection member and the communication member to the metal tube body, wherein the attachment member is a magnet attached to the metal tube body.

2. The coating-forming apparatus of claim 1, further comprising a travel rail disposed parallel to the longitudinal direction of the metal tube body, wherein the robot comprises:

a travel member movably disposed on the travel rail; and an arm rotatably disposed on the travel member, the arm comprising a plurality of links rotatably hinge-coupled to each other, wherein the arm comprises a coupling part, to which a coating gun configured to spray paint or a blasting gun configured to spray abrasive material is selectively coupled, on an end thereof.

3. The coating-forming apparatus of claim 1, further comprising a transfer rail on which the support member is movable.

* * * * *